United States Patent [19]

Ball et al.

[11] 4,322,969

[45] Apr. 6, 1982

[54] GAS PRESSURE RELIEVING HYDROSTATIC TESTER

[75] Inventors: Frank C. Ball, Long Beach; Edmund Wardle, Burbank, both of Calif.

[73] Assignee: Hydro-Test, Inc., Long Beach, Calif.

[21] Appl. No.: 189,182

[22] Filed: Sep. 22, 1980

[51] Int. Cl.[3] ..... G01M 3/08

[52] U.S. Cl. ..... 73/40.5 R

[58] Field of Search ..... 73/151, 40.5 R, 40.5 A; 166/141, 151

[56] References Cited

U.S. PATENT DOCUMENTS 2,963,092 12/1960 Anderson et al. ..... 73/40.5 R X 3,071,960 1/1963 Knapp et al. ..... 73/40.5 R

*Primary Examiner*—Jerry W. Myracle

*Attorney, Agent, or Firm*—William C. Babcock

[57] ABSTRACT

A hydrostatic tester that may be sequentially disposed in stands of tubular members as they are lowered into an oil well bore in which gas under substantial pressure may develop. During the period when the hydrostatic tester is disposed in a stand of tubular members but not in use, an improvement operatively associated with the hydrostatic tester automatically vents gas from the bore hole to the ambient atmosphere prior to the gas pressure building up in the bore hole to the extent that the hydrostatic tester will be blown from the tubular stand with possible injury to the testing crew.

2 Claims, 3 Drawing Figures

FIG. 1
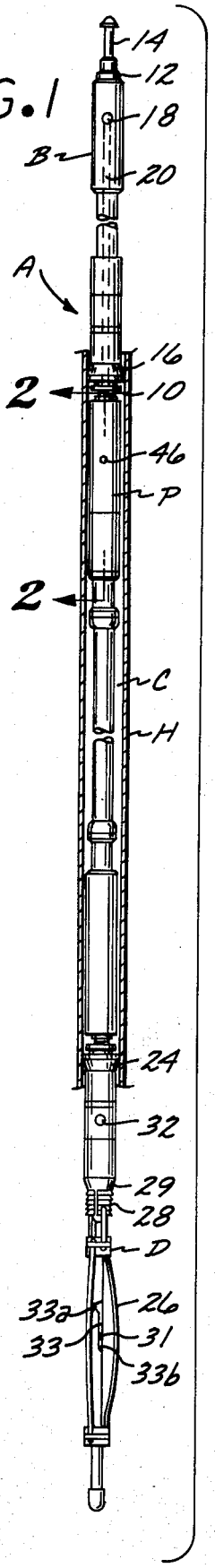
FIG. 2
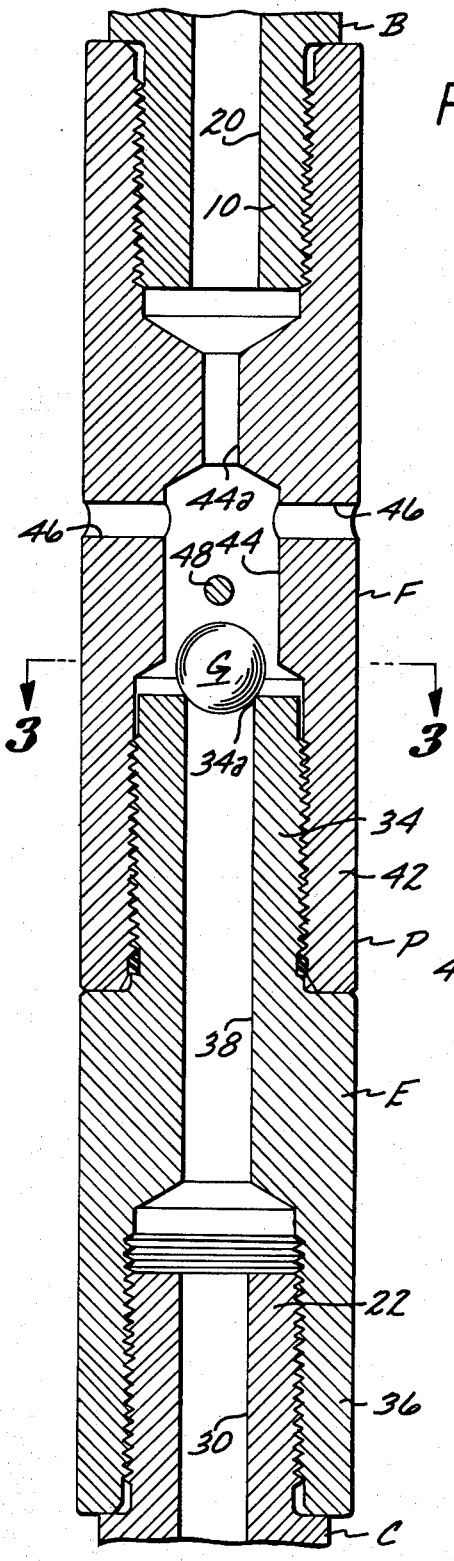
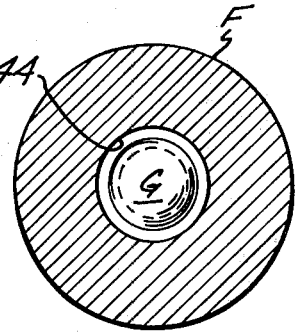
FIG. 3

GAS PRESSURE RELIEVING HYDROSTATIC TESTER

BACKGROUND OF THE INVENTION

1. Field of the Invention

Gas Pressure Relieving Hydrostatic Tester.

2. Description of the Prior Art

As stands of tubular members are sequentially lowered into an oil well bore to be connected together to define a string of tubular members, it is common practice to hydraulically test each tubular stand. Such hydraulic testing is conveniently carried out by a tool that includes a mandrel having a pressurized water inlet therein that by passage means communicates with a pressurized water outlet situated between a pair of longitudinally spaced packers that removably seal with the interior surface of the tubular stand. The interior surface of the tubular stand and the pair of packers cooperate to define an elongate confined space into which the pressurized water is discharged to hydraulically test the span of the tubular stand between the packers.

Prior to and after a hydraulic testing operation the tool may be disposed in a stand of tubular members that are in communication with the oil well bore hole. Should there be a rapid increase in gas pressure in the oil well bore hole, it may reach a magnitude where the force it exerts on the hydrostatic testing tool is sufficient to blow it upwardly from the stand of tubular members with possible injury to the testing crew.

A major object of the present invention is to provide an improved hydrostatic testing device that may be removably disposed in a stand of tubular members in communication with a well bore in which substantial gas pressure may develop, and the improvement automatically venting gas from the bore hole to the ambient atmosphere prior to the pressure of the gas building up to the extent that the gas pressure will force the hydrostatic testing device upwardly out of the stand of tubular members.

SUMMARY OF THE INVENTION

The present invention is used in conjunction with a hydrostatic testing device of the type that includes an elongate mandrel having a lower threaded end, an upper resilient packer mounted on the mandrel adjacent the lower end thereof, and a pressurized water inlet in the mandrel that communicates with a first passage that extends downwardly and longitudinally therein. The hydrostatic tester also includes an elongate member or a series of connected members, with the upper most member having an upper threaded end, a lower resilient packer mounted on the elongate member below the upper threaded end, a springs and slips assembly mounted on the elongate member and a second longitudinal passage in the elongate member that communicates with an opening therein situated below the lower packer.

The present invention includes first and second threadably connected elongate bodies that are interposed between the lower threaded end of the mandrel and the upper threaded end of the elongate members and removably connected thereto.

The first elongate body has an upper threaded portion that defines a valve seat and a lower threaded end that engages the upper threaded end of the elongate member, and the first body having a third passage that extends between the valve seat and the second passage.

Also, an elongate second body is provided that has an upper threaded end that engages the lower threaded end of the mandrel, and a lower threaded end that engages the threaded upper end of the elongate first body, with the elongate second body having a cavity therein that communicates with the first passage and third passage, and a pressurized water discharge opening in the second elongate member. A ball is disposed in the cavity that may rest on the valve seat during the testing operation and seal therewith. A stop is provided in the cavity that limits the upward movement of the ball relative to the ball seat. When the hydrostatic testing unit of which the present invention forms a part is disposed in a tubular string that extends downwardly into an oil well bore hole, the upper and lower packers cooperate with the interior surface of the tubular string when the ball is on the valve seat, to define a confined space into which pressurized water may flow from the inlet, first passage and discharge opening to pressure test the tubular string after the tool has been manipulated relative to the slips and bow spring assembly to set the slip by pressure contact with the interior surface of the tubular string. During the testing operation pressurized water is discharged into the confined space to test the metal of the tubular string situated between the upper and lower packers.

After the hydrostatic testing device has been used in a testing operation as above described, it is capable of remaining in a stationary position in the tubular string when the pressure of gas in the bore hole increases to the extent that were it not for the present invention in the hydrostatic testing unit, the testing unit would be blown upwardly from the tubular string. Excess gas pressure is relieved by the invention, due to the gas flowing upwardly in the second and third passages to dislodge the ball from the valve seat, with the gas continuing to flow upwardly through the cavity and first passage to discharge to the ambient atmosphere through the pressurized water inlet.

BRIEF DESCRIPTION OF THE DRAWINGS

FIG. 1 is a side elevational view of the improved gas relieving hydraulic testing device;

FIG. 2 is a fragmentary longitudinal cross-sectional view of the device taken on the line 2—2 of FIG. 1; and FIG. 3 is a transverse cross-sectional view of the improved portion of the hydrostatic testing unit taken on the line 3—3 of FIG. 2.

DESCRIPTION OF THE PREFERRED EMBODIMENT

The improved gas pressure relieving hydrostatic testing device A as may best be seen in FIG. 1 includes an elongate mandrel B that has a lower threaded end 10, and an upper end 12 that has engageable means 14 secured thereto. The engageable means 14 may be engaged by a conventional grab hook (not shown) secured to a vertically movable wire line (not shown). When the testing device A is supported by the wire line, it may be raised and lowered into stands of tubular members as they are sequentially disposed in the upper portion of an oil well bore in which a substantial gas pressure may develop. The mendrel B has a pressurized water inlet 18 therein that communicates with the first passage 20 that extends downwardly and longitudinally in the mandrel B.

The testing device A also includes a sequence of tubular members C as may be seen in FIG. 1, with the uppermost one of the members having an upper threaded end 22 and the member C supporting a lower resilient packer 24. The tubular member C longitudinally and rotatably support an assembly D that includes bow springs 26 and slips 28. The assembly D includes a tapered surface 29, and when the testing device A is moves downwardly relative to the assembly D the tapered surface 29 moves relative to the slips 28 to radially expand the same and anchor the tool at a fixed position in the stand of tubular members H being hydraulically tested. The tubular members C as can be seen in FIG. 1 support a transversely positioned pin 31 that moves in an inverted J-shaped slot 33. When the tool A is being lowered into a stand of tubular members H, the pin 31 will occupy a first leg 33*a* of the slot 33 and by rotating the tool the pin may be disposed in a second leg 33*b* that permit downward movement of the tapered surface 29 to the slips 28 to radially expand the latter. The tubular members C have a second longitudinal passage 30 defined therein, that communicate with a transverse opening 32 in the members as shown in FIG. 1. The opening 32 is below the lower packer 24 and permits pressurized gas in the tubular member H to flow therethrough and enter the second longitudinal passage 30.

The gas pressure relieving invention P that is used in conjunction with the testing device A includes first and second elongate bodies E and F that are axially aligned and threadedly connected to one another as shown in FIG. 1. The first body E is connected to the upper extremity of the elongate members C, and the second body F to the lower end of mandrel B.

The first body E has a third longitudinal passage 38 therein that is in communication with the second longitudinal passage 30 and the valve seat 34*a*. The invention P also includes an elongate second body F as may be seen in FIG. 2 that has an upper threaded end 40, a lower threaded end 42, and a cavity 44. The cavity 44 has a pressurized water discharge 46 extending outwardly therefrom as shown in FIG. 2. A ball G is provided that is formed from a meterial having a density substantially greater than water, such as steel, with the ball being of a size that it will seal the entrance into the third longitudinal passage 38 when resting on the valve seat 34*a* as shown in FIG. 2. The cavity 44 has a stop 48 therein, which stop is illustrated as being a transverse bar that extends across the cavity 44 and is situated a substantial distance above the ball G when the latter is resting on the valve seat 34*a*.

When the hydrostatic testing device A is disposed in a tubular stand of elongate members H as shown in FIG. 1, the tool will not be forcibly ejected from the tubular stand due to accumulation of gas under pressure in the bore hole in which the stand of tubular members H is disposed. When gas accumulates under pressure in the bore hole to the extent that it will force the device A from the stand of tubular members H, the gas will flow into the opening 32 shown in FIG. 1 and then upwardly to the second longitudinal passage 30 to the third longitudinal passage 38 and displace the ball G from the valve seat 34*a*. The flow of gas will then continue upwardly through the cavity 44 and an extension 44*a* thereof to the first passage 20 to discharge through the pressurized water inlet 18 to the ambient atmosphere. The hydrostatic testing device A when including the invention P will automatically vent pressurized gas from the stand of tubular members H, and as a result the possibility of the device A being forcibly ejected from the stand of tubular members H by gas pressure is eliminated, as is the possibility of the testing crew being damaged by such forceful ejection of the testing device.

The use and operation of the improved gas pressure relieving hydrostatic tester A has been described previously in detail and need not be repeated.

What is claimed is:

1. In combination with a hydrostatic testing device of a structure that includes an elongate mandrel having a lower threaded end, an upper resilient packer mounted on said mandrel adjacent said lower end, a pressurized water inlet in said mandrel that communicates with a first passage that extends downwardly and longitudinally in said mandrel; an elongate member that has an upper threaded end, a lower resilient packer mounted on said elongate member below said upper threaded end, a bow spring and slips assembly mounted on said elongate member, a second longitudinal passage in said elongate member that communicates with an opening in the latter below said lower packer, the improvement for preventing said testing device being blown out of a tubular string when the latter extends downwardly in an oil well bore in which substantial gas pressure may develop, said improvement comprising:

a. an elongate first body having an upper threaded portion that defines a valve seat and a lower threaded end that engages said upper threaded end of said elongate member, said elongate first body having a third longitudinal passage that extends between said valve seat and second passage;

b. an elongate second body that has an upper threaded end that engages said lower threaded end of said mandrel and a lower threaded end that engages said threaded upper end of said elongate first body, said elongate second body having a cavity therein that communicates with said first passage and third passage, and with a pressurized water discharge opening in said second body above said valve seat;

c. a ball in said cavity that may rest on said valve seat and seal therewith; and d. a stop in said cavity that limits the upward movement of said ball relative to said valve seat, said testing device when disposed in a tubular string having said upper and lower packers cooperating with the interior surface of the latter, with said ball on said valve seat, to define a confined space into which pressurized water may flow from said inlet, first passage and discharge opening to pressure test said tubular string after the latter has been manipulated relative to said slips and bow springs assembly to set said slips, and said device after a testing operation has been completed capable of remaining in a stationary position in said tubular string when the pressure of gas in said bore hole increases substantially, said gas entering said opening in said elongate member to flow upwardly in said second and third passage to dislodge said ball from said seat and continue to flow upwardly through said cavity and first passage to discharge to the ambient atmosphere through said pressurized water inlet.

2. The improvement as defined in claim 1 in which said stop is a bar that extends transversely across said cavity.

* * * * *